US005758461A

United States Patent [19]

McManus

[11] Patent Number: 5,758,461

[45] Date of Patent: Jun. 2, 1998

[54] LIGHTWEIGHT, PREFABRICATED BUILDING STRUCTURES

[75] Inventor: Frank J. McManus, Escondido, Calif.

[73] Assignee: Robert D. Holmes, Escondido, Calif.

[21] Appl. No.: 700,652

[22] Filed: Aug. 14, 1996

Related U.S. Application Data

[63] Continuation of Ser. No. 503,128, Jul. 17, 1995, abandoned.

[51] Int. Cl.[6] ..... E02D 27/00

[52] U.S. Cl. ..... 52/293.3; 52/271; 52/592.1; 52/598.6; 52/274; 52/276; 52/582.2; 52/591.5; 52/295; 52/587.1; 52/766

[58] Field of Search ..... 52/592.1, 598.6, 52/588.1, 271, 293.3, 274, 276, 766, 582.2, 591.5, 745.1, 745.21, 295, 587.1, 251; 70/177, DIG. 11, DIG. 16; 403/343, 342, 409.1, 374

[56] References Cited

U.S. PATENT DOCUMENTS

| | | | |
|---|---|---|---|
| 2,143,439 | 1/1939 | Friend | 70/DIG. 11 X |
| 2,329,348 | 9/1943 | Honig | 70/DIG. 11 X |
| 3,224,155 | 12/1965 | Rook . | |
| 3,468,771 | 9/1969 | Pedlow . | |
| 3,712,653 | 1/1973 | Lehmann | 52/582.2 |
| 3,727,355 | 4/1973 | Vachon . | |
| 3,780,478 | 12/1973 | Pavlecka . | |
| 3,820,294 | 6/1974 | Parker . | |
| 3,857,210 | 12/1974 | Austin . | |
| 3,875,714 | 4/1975 | Nayler et al. . | |
| 4,045,927 | 9/1977 | Diaz . | |
| 4,079,559 | 3/1978 | Tenbrummeler | 52/295 |
| 4,236,366 | 12/1980 | Rijnders . | |
| 4,417,430 | 11/1983 | Loikitz | 52/582.2 |
| 4,512,122 | 4/1985 | Berkowitz | 52/582.2 X |
| 4,513,593 | 4/1985 | Wilson | 70/DIG. 11 X |
| 4,598,240 | 7/1986 | Kendall et al. . | |
| 4,598,522 | 7/1986 | Hoofe, III . | |
| 4,630,418 | 12/1986 | Degut . | |
| 4,655,013 | 4/1987 | Ritland . | |
| 4,656,797 | 4/1987 | Marquart . | |
| 4,671,032 | 6/1987 | Reynolds . | |
| 4,823,534 | 4/1989 | Hebinck | 52/251 X |
| 4,854,097 | 8/1989 | Haener . | |
| 4,967,531 | 11/1990 | Giles et al. | 52/587.1 |
| 4,972,634 | 11/1990 | Dresden . | |
| 4,984,406 | 1/1991 | Friesen . | |
| 4,998,396 | 3/1991 | Palmersten . | |
| 5,014,478 | 5/1991 | Spring . | |
| 5,069,263 | 12/1991 | Edwards . | |
| 5,222,902 | 6/1993 | Piersch . | |
| 5,349,796 | 9/1994 | Meyerson . | |
| 5,435,109 | 7/1995 | Kim | 52/582.2 X |

OTHER PUBLICATIONS

Kason® Panel Fasteners product brochure, pp. 95 and 96.

*Primary Examiner*—W. Glenn Edwards
*Attorney, Agent, or Firm*—Coudert Brothers

[57] ABSTRACT

A lightweight, prefabricated building structure is assembled from panels having positive attachment means for attaching each of the panels to a suitable foundation. Each of the panels has friction lock means for interlocking one to another. Roof panels are provided which are joinable to the edge on the upper surface of the panels by the same type of friction lock means. Panels consisting of polyurethane can be easily shipped to a building site and erected with a minimum of cost and manual labor.

41 Claims, 14 Drawing Sheets

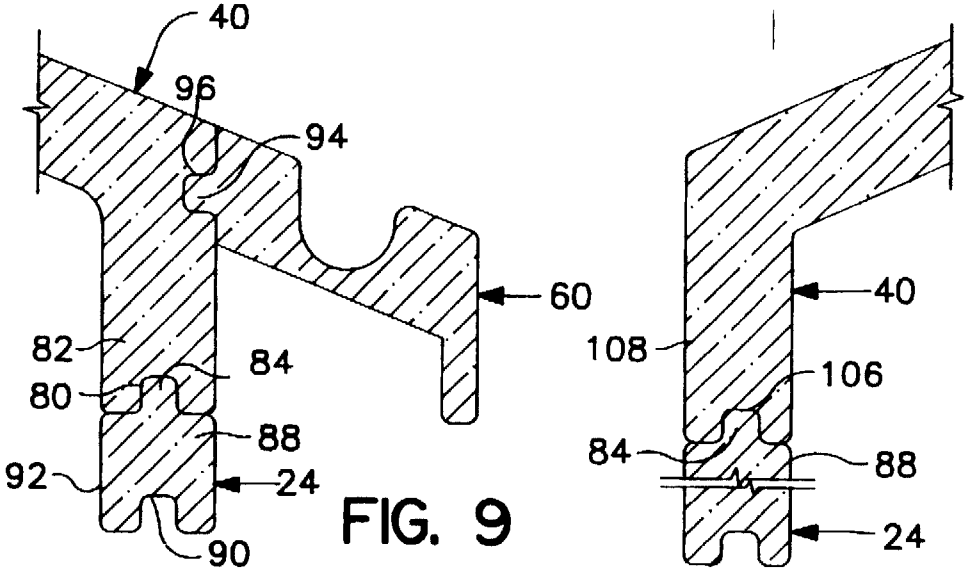
FIG. 9
FIG. 11
FIG. 8
FIG. 12
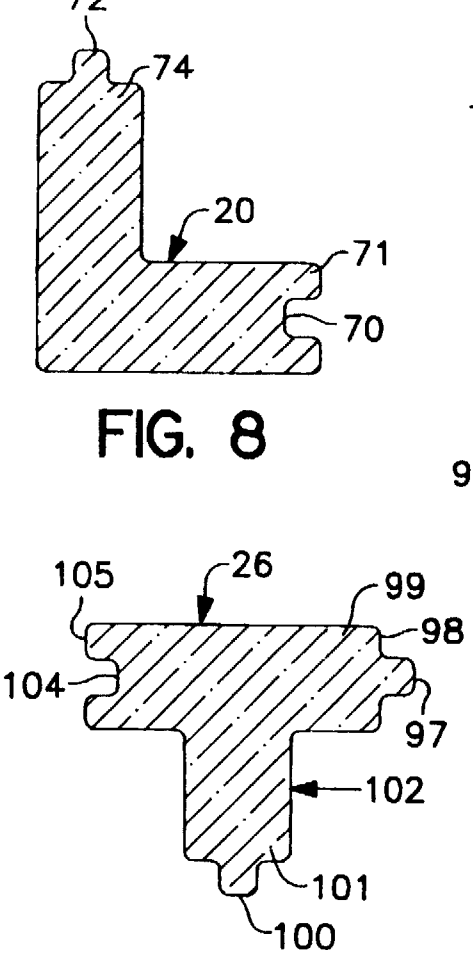
FIG. 10

LIGHTWEIGHT, PREFABRICATED BUILDING STRUCTURES

This application is a continuation of U.S. application Ser. No. 08/503,128, filed Jul. 17, 1995, now abandoned.

BACKGROUND OF THE INVENTION

1. Field of the Invention

This invention relates to lightweight, prefabricated, fully formed structural elements that can be quickly assembled into low-cost residential and commercial building structures. More particularly, this invention relates to a plurality of panels of polyurethane rigid foam which can easily be shipped via shipping pallets for assembly of the structures on suitable foundations such as pre-poured concrete slabs and footings.

2. Description of the Prior Art

There are over a billion people living in substandard housing throughout the world. They are from countries of the former U. S. S. R. and Africa, from the Philippines, China, India, from other developed and developing countries of the world. In addition to people living in substandard housing, thousands of people have had their homes destroyed through wars and natural disasters. These people require an immediate solution to their housing needs. As we move toward the twenty-first century, there is a great need to find a more efficient way to provide adequate housing for such people. A revolutionary way has been found to satisfy this great need which utilizes relatively new materials and imaginative design characteristics.

Rigid polyurethane foams and other expanded polymeric materials have long been used between metal or wood exterior skins in the construction of building panels; see U.S. Pat. No. 3,875,714 directed to interlocking panels for floating covers for storage tanks; U.S. Pat. No. 4,045,927 directed to wall construction for cold storage rooms; U.S. Pat. No. 4,589,240 directed to foam core panels for overhead doors; U.S. Pat. No. 4,598,522 directed to interlocking panels for roofing; U.S. Pat. No. 4,998,396 directed to interlocking panels for various commercial and architectural purposes; and 5,349,796 directed to panels having a foam core for building purposes. Rigid polyurethane foams have been used for lightweight interior wall partitions; see U.S. Pat. No. 4,972,634 directed to portable walling for interior wall sections; and U.S. Pat. No. 4,014,478 directed to panels for interior divider walls. However, there is no known prior art reference directed to residential and commercial building structures consisting almost exclusively of rigid polyurethane foam compositions. The only known prior art in which the entire building structure is made of a plastic material is directed to toy interlocking blocks; see, for example, U.S. Pat. No. 5,222,902.

Rigid cellular polyurethane compositions, referred to herein as polyurethane rigid foam or PUR foam, is intended to include polyurethane, polyisocyanate and polyurethane-polyisocyanuarate structural foams formed by combining a suitable catalyst with a precursor mixture. Such a mixture comprises a polyol, an isocyanate, a blowing agent, a foam stabilizer in a suitable mixing device or mold to produce the foamed plastic by techniques well known in the art. Additional components can be added to the mixture including suitable surfactants, oxidants and the like. A more detailed discussion of the preparation of PUR foams can be found in the following U.S. Pat. Nos. 3,746,663; 3,892,687; 3,883,652; and 4,116,879; the pertinent portions of which are incorporated by reference herein.

There is a tremendous need for lightweight, prefabricated panels which can easily be assembled into residential housing and commercial structures at costs which are less than the $25 to $30 per square foot for the construction of the present lowest cost housing.

SUMMARY OF THE INVENTION

The present invention provides a lightweight, prefabricated building structure comprising a plurality of wall panels having positive attachment means for attaching each of the wall panels to a suitable foundation, and friction lock means for joining the wall panels and a plurality of roof panels joinable to the wall panels by friction lock means. The positive attachment means includes a plurality of fasteners which are within the wall panels and each fastener locks or engages with a corresponding fastener within the foundation.

The structure consists of a rigid polyurethane foam. More preferably, each of the elements or parts that make up the structure consists of a specially formulated, self-skinning rigid polyurethane core, exterior wall and interior wall. The exterior wall is of the same basic composition as the core, but as a result of the self-skinning effect of special formulations, the outer skin can be designed to incorporate several variations.

Each of the standard wall panels has a top edge, a bottom edge, a first side edge, a second side edge and a length to width ratio in the range of about two to about three. However, depending on the particular geometric design of the building, nonstandard wall panels having three or more than four sides are included within the purview of the present invention.

The exterior wall or side of the panel is separated from the interior wall by a thickness of at least one inch, preferably about two to about five inches. The roof panels typically have either three or four edges depending on the particular configuration. However, other geometric shapes are within the purview of the present invention. The only limit for the geometric shape of either the wall panels or the roof panels are one of practicality. A triangular roof panel is preferred as set forth in more detail below. With the exception of the bottom edge of the wall panels, the remaining edges of the wall panels and the sides of the roof panels are molded with a suitable friction lock means.

Friction lock means used to join an edge or side of one panel to an edge or a side of another panel include means which have been used for decades in cabinet making to join edges. Examples of typical friction lock means include lap joints or lap splices, dove tail joints, dowel joints, pin fitting joints, compression fitting joints, tenon and mortise, and tongue and groove.

The preferred friction lock means for use in joining or interlocking the panels and other building elements of the present invention is either tenon and mortise or tongue and groove. In the following description of the use of friction lock means for joining various elements of the present invention, the use of the term "panel" is intended to include other building elements that are not usually defined as panels, e.g. roof ridges, roof caps, support beams, floor separation members and the like. The basic difference between tenon and mortise and tongue and groove is that in tenon and mortise, the tenon or projection does not take up or occupy the entire length of a side or an edge of a panel and the tenon is inserted into the corresponding hole, notch or slot in the mating side or edge of the adjacent panel. In tongue and groove, the tongue does occupy substantially the entire length of the side or edge of the panel and the corresponding groove begins at the corner of the panel and ends at the opposite corner. The other friction lock fitting means described above can be used where less rigorous building standards are not required.

The preferred friction lock means comprises a groove along the entire length of the first side edge or top edge of the wall panel or one edge of the roof panel and a tongue along the entire length of the second side edge or top edge of the wall panel or another edge of the roof panel. In other words, the panel joining groove has a length that is substantially the same as the length or width of the panel. The groove has a width of approximately one third the thickness of the panel and is generally centered between the interior and exterior walls. For maximum friction fit, it is preferred that the depth of the groove is slightly greater than the thickness of the panel. Correspondingly, the panel joining tongue has a length that is substantially the same as the length or width of the panel and is designed for a tight friction fit within the groove of the adjacent panel.

It is apparent from the foregoing, that each of the standard wall panels can have either a tongue or a groove along substantially the entire top edge for respectively mating with a corresponding groove or tongue in a roof panel. The exact configuration of the bottom edge of a standard wall panel will depend on the specific type of positive attachment means used to affix the standard wall panel to the foundation.

In one embodiment of the present invention, a corner can be formed by having a groove along substantially the entire length of the interior wall of a wall panel adjacent and parallel to the first side edge and a corresponding tongue along substantially the length of the interior wall panel adjacent and parallel to the second side edge. However, it is greatly preferred to mold the corner panel to the desired angle, for example, into a shape having a right angle cross-section with a groove along the length of a first corner edge and a tongue along the length of a second corner edge in the same manner as described above in connection with the wall panels.

BRIEF DESCRIPTION OF THE DRAWINGS

FIG. 8 is a transverse sectional view of a typical corner panel taken along section line 8—8 shown in FIG. 5;

FIG. 9 is a vertical sectional view of a typical overhang roof panel joined by means of a tongue in a groove in the lower edge of a typical roof panel and a tongue in a top edge of a wall panel joined to a groove in the lower edge of the roof panel taken along section line 9—9 shown in FIG. 2;

FIG. 10 is a transverse sectional view of a right section of a typical "T" panel-interior wall panel (T-panel) taken along section line 10—10 shown in FIG. 5;

FIG. 11 is a vertical sectional view of a groove in the lower edge of the roof panel joined to a tongue in the top edge of a wall panel, corner panel or T-panel;

FIG. 12 is a transverse sectional view of a wall panel taken along section line 12—12 shown in FIG. 5;

DESCRIPTION OF A PREFERRED EMBODIMENT

Figure 1B:
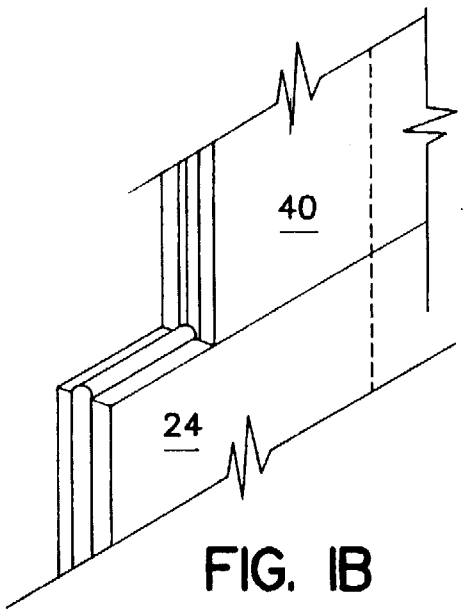
FIG. 1 is a prospective view of the front, left side and roof of one embodiment of the present invention, a lightweight, prefabricated one story residential or commercial building, with a break-outs to show details for joining the panels.

Referring now to FIGS. 1–7, a single story residential or commercial building 10 of one embodiment of the present invention is shown assembled from various panels described below. Building 10 has front 12, left side 14, right side (not shown) which is identical to left side 14, rear 16, and roof 18. Comer panels 20, wall panels 22 under window 23, wall panels 24, T-panels 26, interior wall panels 28 and interior corner panel 29 are all attached to footing 30—slab 32 of a typical poured concrete foundation 34 by a variety of positive attachment means, one of which is described in further detail below in connection with FIGS. 13–14. Header panel 35 over door 36 is just one example of a variety of framing panels for doors, windows, air conditioning units and the like. The minimum length for such specialty panels is about one foot and the minimum width is about six inches. Triangular roof panels 40 and 42 are assembled by the same friction lock means described below in connection with the other panels of the present invention. Triangular panels 42 each meet at apex 44 of assembled roof 45 and apex 44 is capped with roof cap 46. Roof ridges 50 cover seams 52 between the pairs of triangular roof panels 40 and 42. Support beams 54 are joined between wall panels 24 and roof panels 42. Overhang roof panels are joined to triangular roof panels 40 by friction lock means described below. Downspouts 62 are attached by conventional means to gutter 64 within overhang roof panels 60. Overhang roof panels 60 are designed to "break-away" or become disassembled from roof panels 40 while leaving the basic building of the present invention intact during very high winds, but at least 120 miles per hour Class "D" winds for which the remaining building is designed to withstand.

FIG. 8 shows corner panel 20 having groove 70 along one side edge 71 and tongue 72 along the other side edge 74. Groove 70 is joined by means of a corresponding tongue in wall panel 24 or in wall panel 22.

FIG. 9 shows groove 80 along the edge of lower section 82 of roof panel 40 joined to tongue 84 along the edge in upper section 88 of wall panel 24. 90 in lower section 92 of wall panel 24 is joined to foundation 34 by positive attachment means described below. Tongue 94 of overhang roof panel 60 is joined to groove 96 in lower section 82 of roof panel 40.

FIG. 10 shows tongue 97 along exterior side edge 98 in exterior section 99 of T-panel 26 for joining or interlocking with a corresponding groove in wall panel 24 or wall panel 22, tongue 100 along interior side edge 101 in interior wall section 102 for joining with a side edge of interior wall panel 28, and groove 104 along exterior side edge 105 in exterior section 99 for joining with a corresponding tongue along the side edge of wall panel 24 or wall panel 22.

FIG. 11 shows groove 106 along the edge in lower section 108 of roof panel 40 joined to tongue 84 along the edge in upper section 88 of wall panel 24.

FIG. 12 shows wall panel 24 having groove 110 along one side edge 112 of wall panel 24 and tongue 114 along the other side edge 116. Groove 110 is joined to a corresponding tongue 114 in another wall panel 24, or a tongue in wall panel 22, header panel 35 or corner panel 20.

In the embodiment of the present invention described in the foregoing, wall panels 24 have a length in the range of about six to about ten feet, preferably seven feet and a width in the range from about two to about four feet, preferably three feet. In other embodiments of the present invention, the maximum practical width for the wall panels is about 20 feet and the maximum practical length for the wall panels is about 50 feet. The thicknesses of all of the panels of the present invention including, but not limited to wall panels 22 and 24, corner panels 20, T-panels 26, header panels 35, roof panels 40 and 42, support beams 54, and overhang roof panels 60 are in the range from about one inch to about six inches. The optimum thickness of about three and a half inches or the width of standard 2×4-inch studs, i.e., upright members used in forming the frame of a wall or partition and covered with plasterwork, siding, and the like. It is apparent that corner panels 20 can be formed at angles other than 90° to form buildings having other than conventional square or rectangular rooms. Similarly, T-panels 26 can be replaced by a combination interior-exterior wall panel having an angle less than or greater than 90°, preferably in the range to about 30° to about 60°.

Grooves of the type shown in FIGS. 9 and 11 as grooves 80, 96 and 104, extend along the entire width from one corner to the other of each of the panels including wall panels 22, wall panels 24, corner panels 20, T-panels 25, header panels 35 and roof panels 40. Correspondingly, tongues of the type shown in FIGS. 9 and 11 as tongue 84, respectively extend along the entire width of such panels.

Similarly, grooves of the type shown in FIGS. 8, 10 and 12 as grooves 70, 104 and 110, extend along the entire length of one side edge of each of panels including wall panels 24, corner panels 20, T-panels 26, as well as interior wall panels 28, header panels 35 and roof panels 40 and 42. Correspondingly, tongues of the type shown in FIGS. 8 and 10 as tongues 72, 97, and 100, respectively extend along the entire length of the other side edge of each of such panels.

Each of the grooves has a width of substantially one-third the thickness of the panels and a depth of slightly greater than the thickness of the panels. For a panel having a preferred thickness of about three and a half inches, the grooves have a width of about one and one sixth and a depth of about one and a half inches. Correspondingly, the tongues have a width and length that matches that of the grooves with zero tolerances. The tongues of wall panels 24, that are designed to weigh approximately 25 pounds, can be inserted into the corresponding grooves easily by hand without the use of any tools. Because of the zero tolerance in the dimensions of the tongues and grooves, once the panels are joined by such friction lock means it is almost impossible for one person to separate the panels. Prior to joining the panels, an adhesive is applied on the tongues and grooves as a sealant to prevent moisture from entering the building through seams between the panels. The tongues and grooves shown in FIGS. 8–12 have rounded edges. However, such edges can be tapered or squared off without affecting the utility of the present invention. While it is preferred that the grooves and tongues be provided substantially along the entire periphery to all panels of this invention except the bottom surface that contacts the foundation, structural integrity can be achieved even if gaps remain along the periphery as in the use of tenon and mortise.

Figure 13:
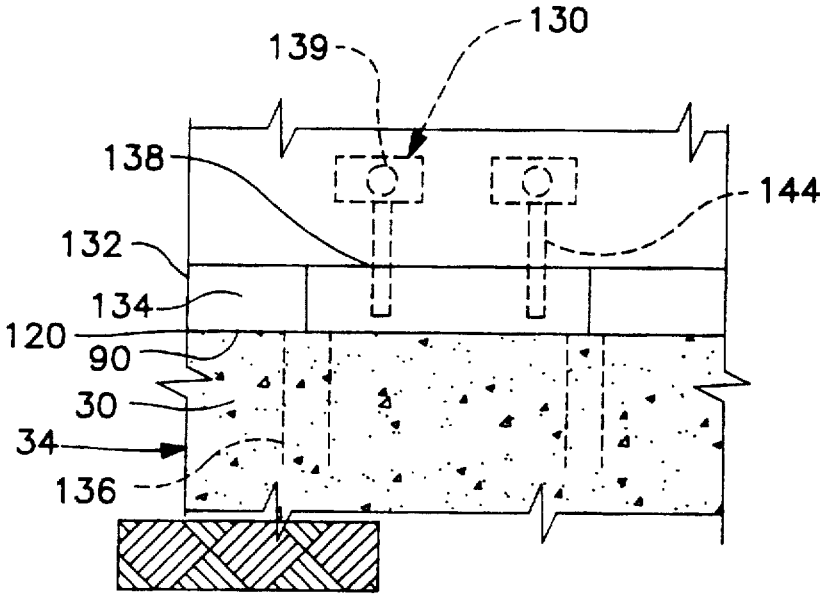
FIG. 13 is a detailed vertical sectional view of one type of positive attachment means for affixing the wall panels, corner panels, T-panels and interior wall panels to the foundation.
Figure 14:
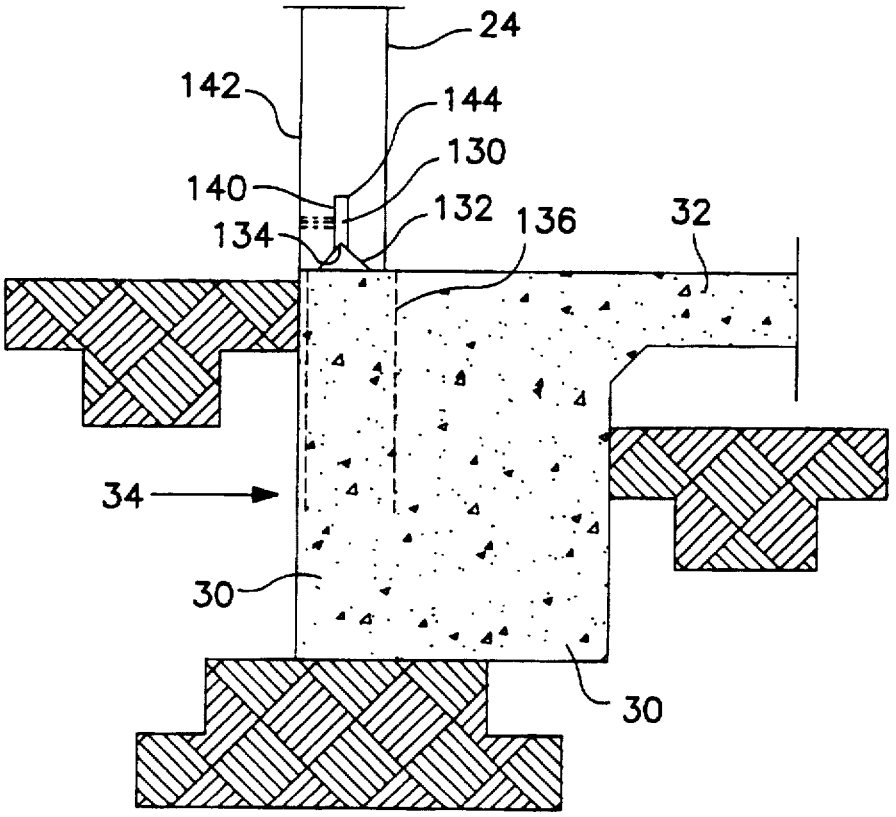
FIG. 14 is a vertical sectional view of the positive attachment means for affixing the wall panels, corner panels, T-panels and interior wall panels to the foundation.

FIGS. 13–14 illustrate one suitable type of positive attachment means for affixing corner panels 20, wall panels 22 under window 21, wall panels 24, T-panels 26, and interior wall panels 28 to foundation 34.

In FIG. 13, layer 120 of a suitable adhesive is first applied to foundation 34 and to, for example, bottom 90 of wall panel 24 to serve as a sealant between the foundation and all of the panels affixed to the foundation including the wall panels, corner panels, T-panels and interior panels. The adhesive provides a strong bond between foundation 34 and the polyurethane of the panel and prevents moisture from seeping within the structure.

Typical adhesives for use in the assembly of the panels of the present invention include polymer-based adhesives and caulking compounds that are particularly adapted to bonding with PUR foam. One acceptable adhesive is sold under the trademark Sikaflex 201. A suitable primer should be applied to the surfaces to be bonded and allowed to dry for a sufficient period of time, e.g., at least 30 minutes, before application of the adhesive to improve the adhesion of the panel to the foundation. One such primer is sold under the trademark Sikaflex 203.

Referring to FIGS. 13–14, wall panel 24 is shown attached to footer 30 by a preferred fastener which is male lock-female lock attachment mechanism 130 and is commercially available under the generic name "CAM-LOCK" anchors. Base 132 for each CAM-LOCK anchor 130 is mounted on mound 134 and is bolted to footer 30 and slab 32 (not shown) with anchor bolts 136. Base 132 ranges in length from six to 12 inches, preferably about 10 inches. One female insert 138 is provided for in the range of about every six to eighteen inches of the footer-slab periphery of foundation 34. The exact number of inserts will depend on the design specifications for a given structure. In the embodiment shown, there are two CAM-LOCK female inserts 138 for each panel 24. Each female insert 138 is provided with a plastic sleeve 139. Similarly, two CAM-LOCK male inserts 140 are molded within lower section 142 of wall panel 24 to be in registry with corresponding female inserts 138. Male insert 140 includes rod 144 consisting essentially of a metal, an engineering plastic or an injection molded nylon. Examples of suitable engineering plastics include polycarbonate-based plastics. Each male insert 140 is placed in the mold before the end of the gel time for the PUR foam.

Each panel 24 containing male inserts 140 is easily placed by hand over bases 132 for male rods 144 to be inserted into their corresponding female inserts 138. Once panel 24 is in place, a suitable tool, i.e., an Allen wrench, is used to drive rods 144 into female inserts 130 perpendicular to the horizontal plane of foundation 34. Plastic sleeve 139 is used to compensate for any slight dimensional difference in placement. Each CAM-LOCK anchor 138 is designed to hold down the structure and to withstand about 1150 pounds of force. The use of the CAM-LOCK anchors as the positive attachment means provides sufficient strength so that the resulting building structure of the present invention is able to withstand 120 miles per hour Class "D" wind forces in accordance with the 1991 Uniform Building Code.

Although CAM-LOCK attachment means have been described to attach the wall panels to the foundation, it is apparent to one skilled in the art that such means can be used to positively attach or otherwise interlock each of the panels of the structure to one another in order for the structure to be able to withstand wind velocities greater than 70 miles per hour. In addition, other suitable fasteners can be used such as lag nuts and bolts, screws, locking pins and the like depending on the particular application. Although the conventional concrete footing-slab foundation is the preferred base for the embodiment of the building of the present invention described above, the foundation can be replaced by any suitable base. It is contemplated that the structures of the present invention can be attached to a wooden or steel pier, off-shore platform, and the like by means of any of the type of positive attachment means set forth above. The critical feature of all such positive attachment means is that each of the fasteners, e.g., male inserts, bolts, screws, locking pins and the like, is molded within the wall panel during the foam gelling procedure. The corresponding fastener for connecting with the wall panel fastener is mounted within the base.

Figure 1A:
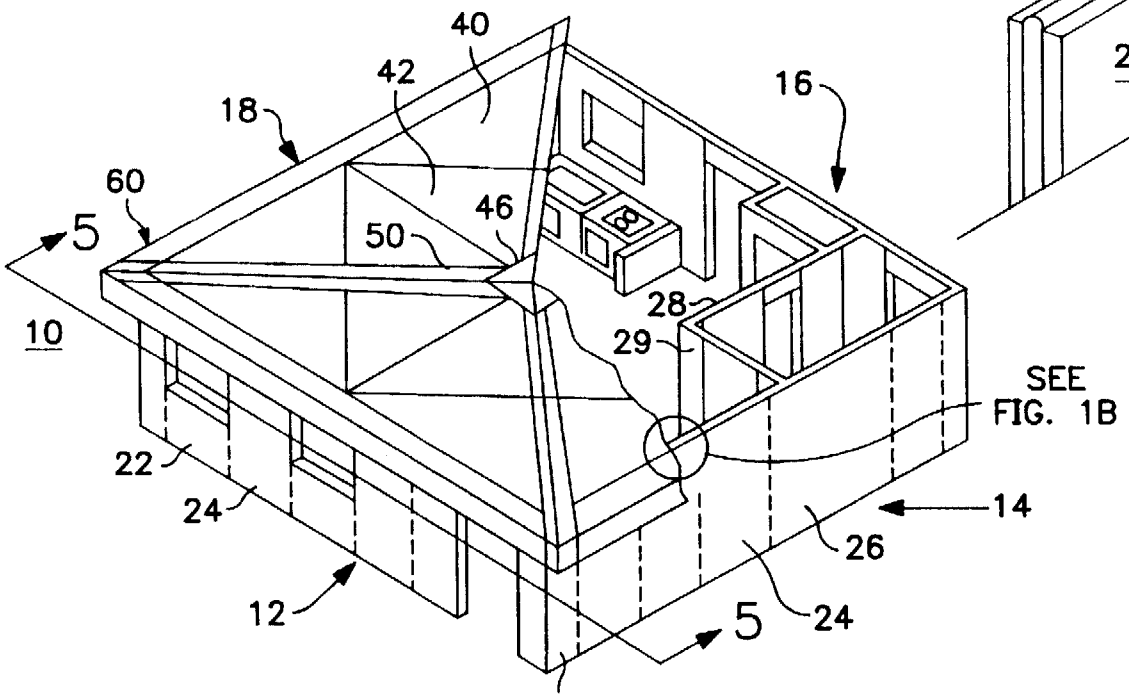
Figure 2:
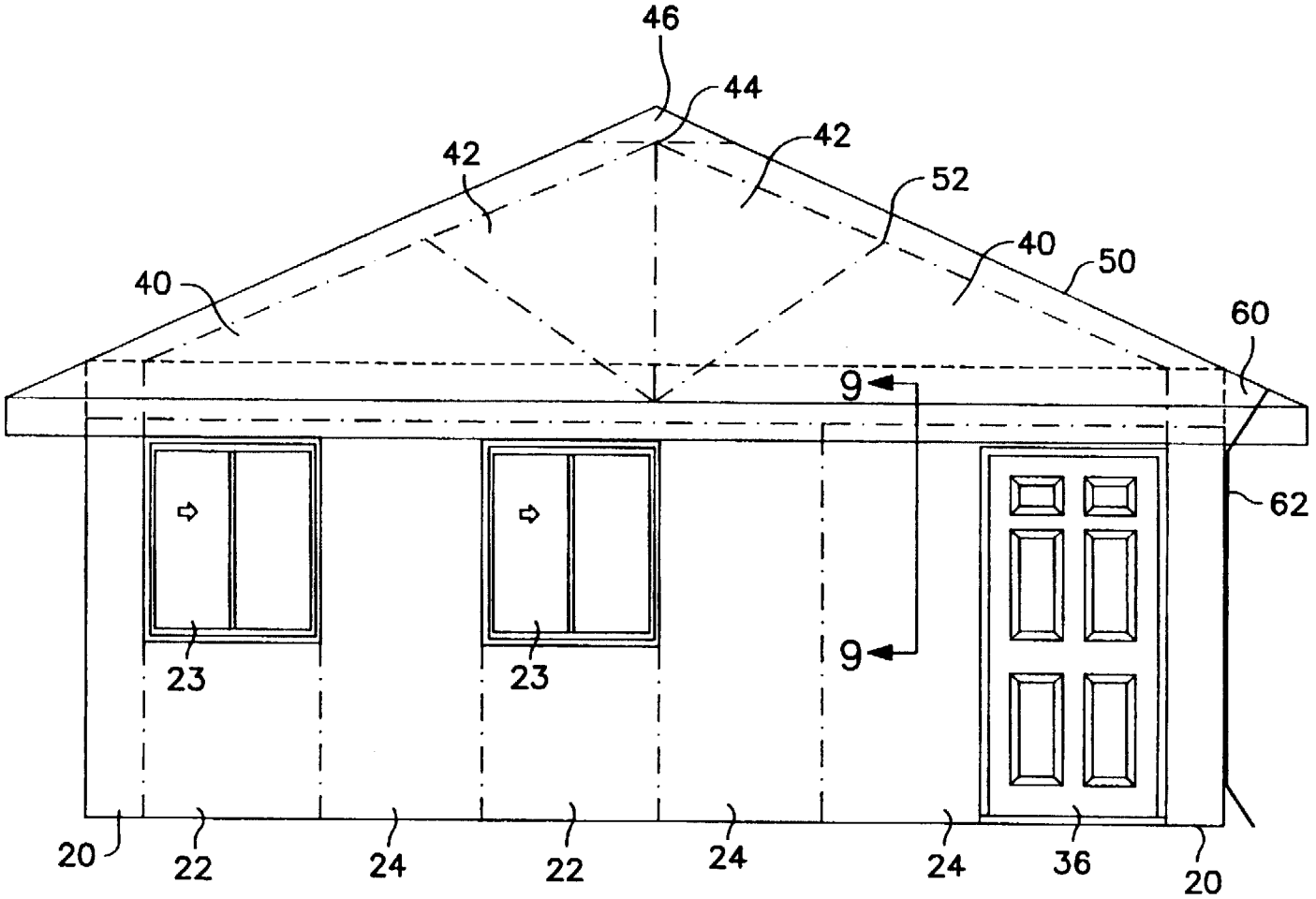
FIG. 2 is a front elevational view of the building shown in FIG. 1.
Figure 3:
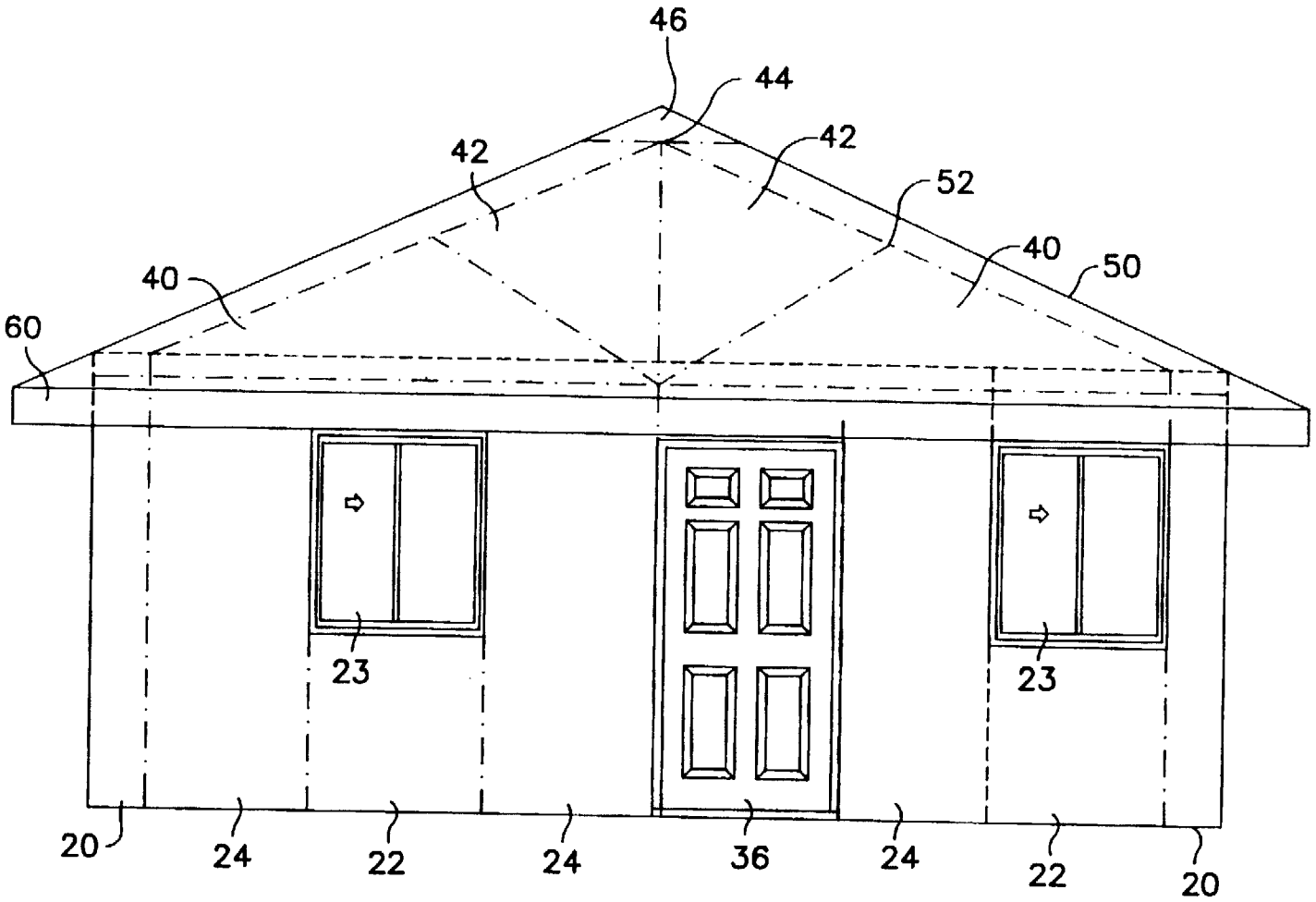
FIG. 3 is a rear elevational view shown in the building shown in FIG. 1.
Figure 4:
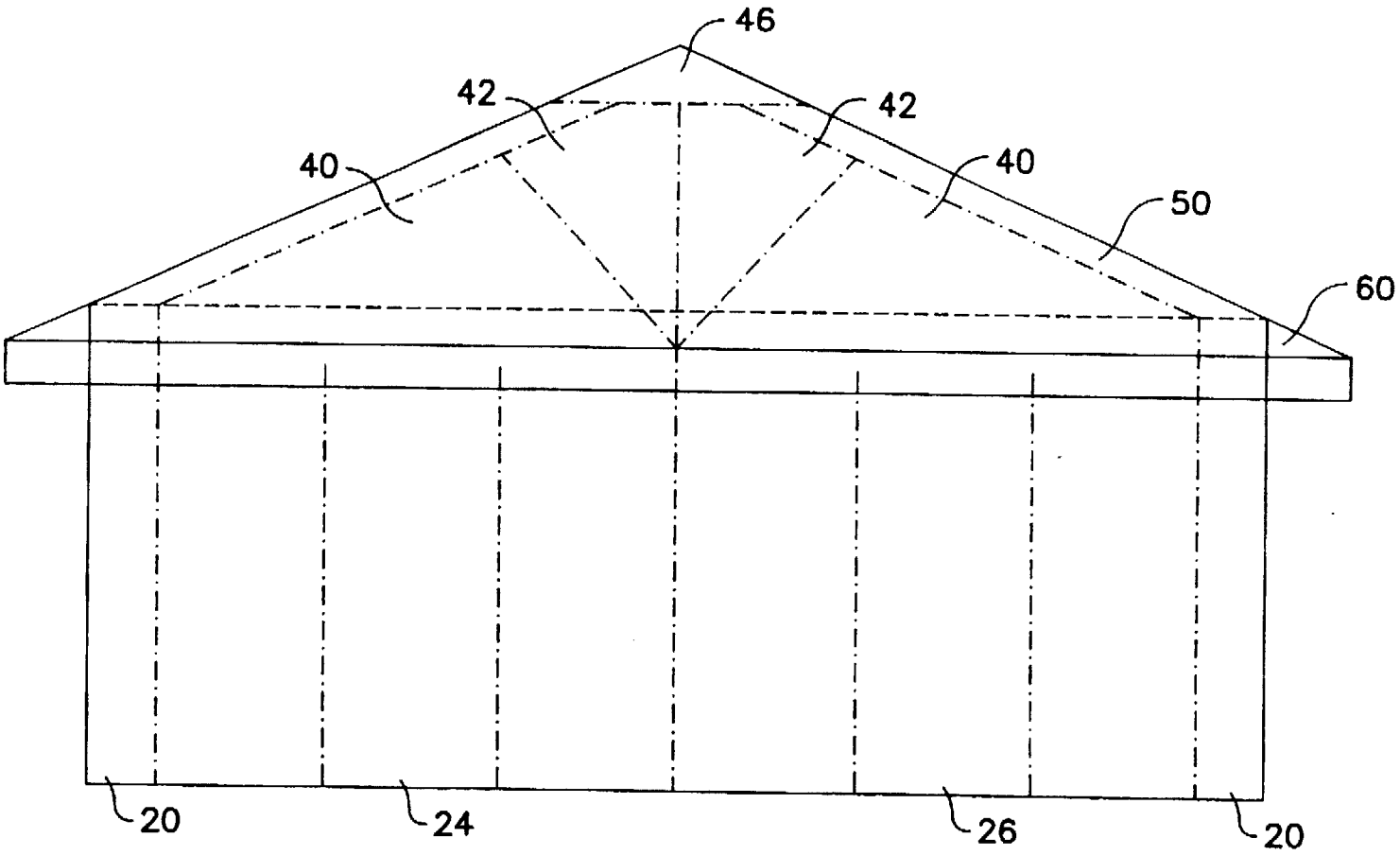
FIG. 4 is either a right side or a left side elevational view of the building shown in FIG. 1.
Figure 5:
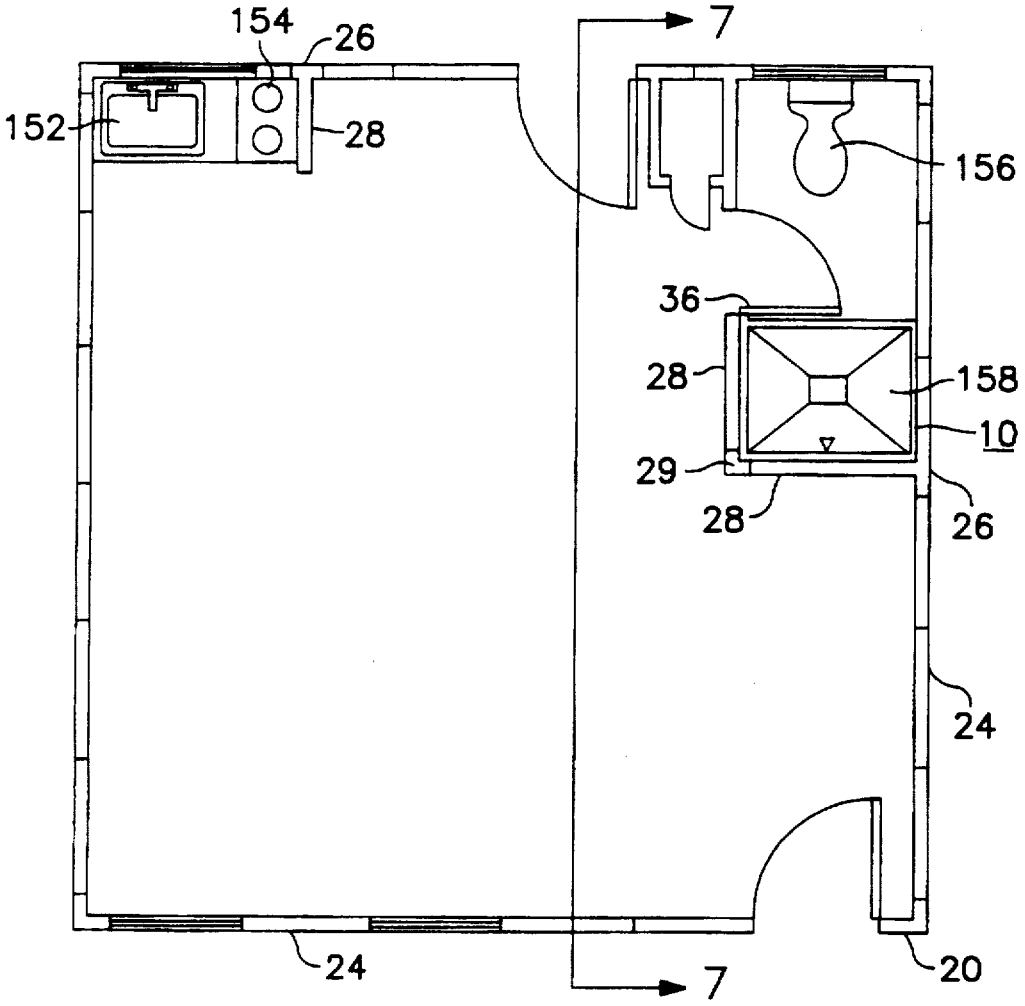
FIG. 5 is a plan view, partially in cross-section, taken along section line 5—5 shown in FIG. 1 showing a typical floor plan of the building shown in FIG. 1.
Figure 6:
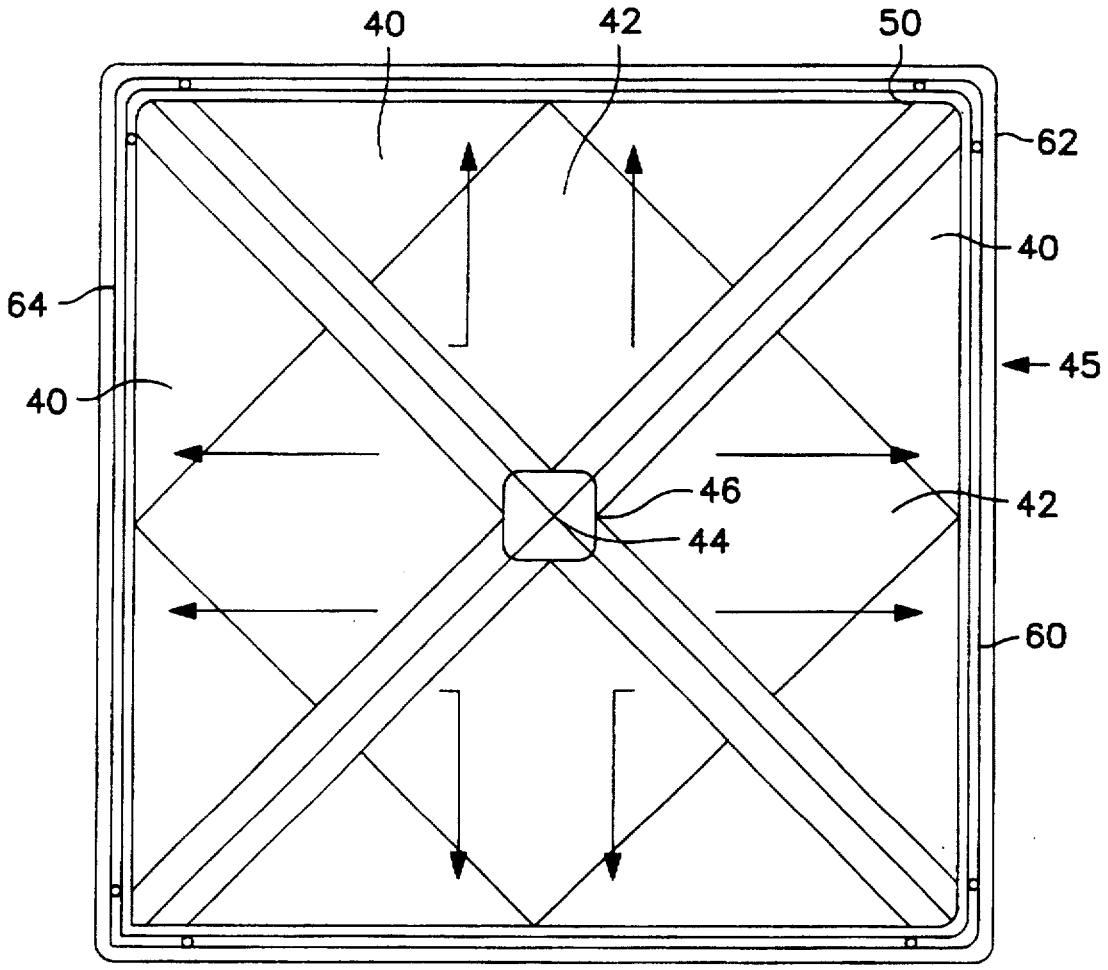
FIG. 6 is a top plan view, partially in cross-section, showing a typical roof plan of the building shown in FIG. 1.
Figure 7:
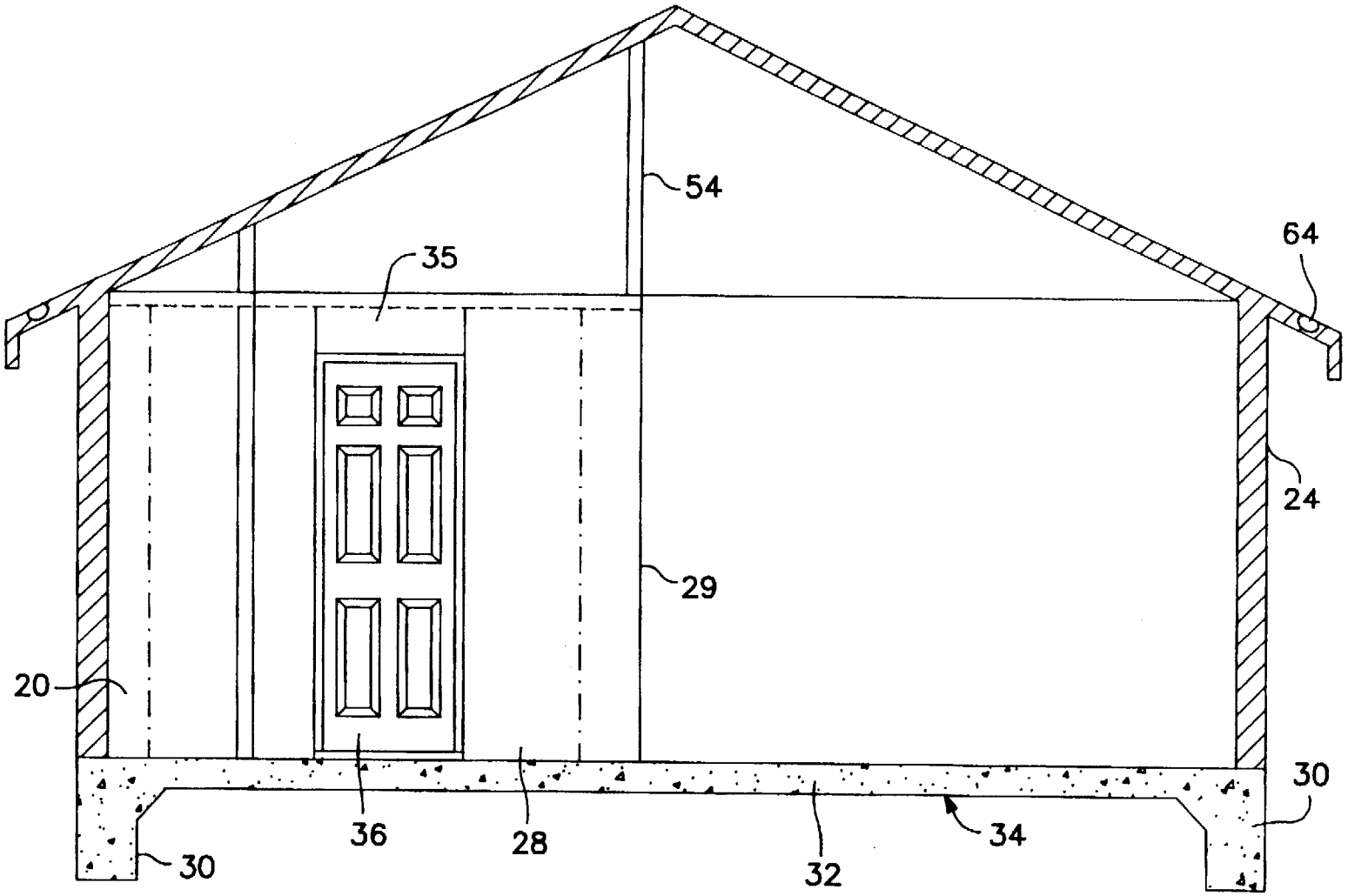
FIG. 7 is a sectional view of the building shown in FIG. 1 taken along section line 7—7 shown in FIG. 5 to show the support beams and the attachment of the panels to the foundation.
Figure 15:
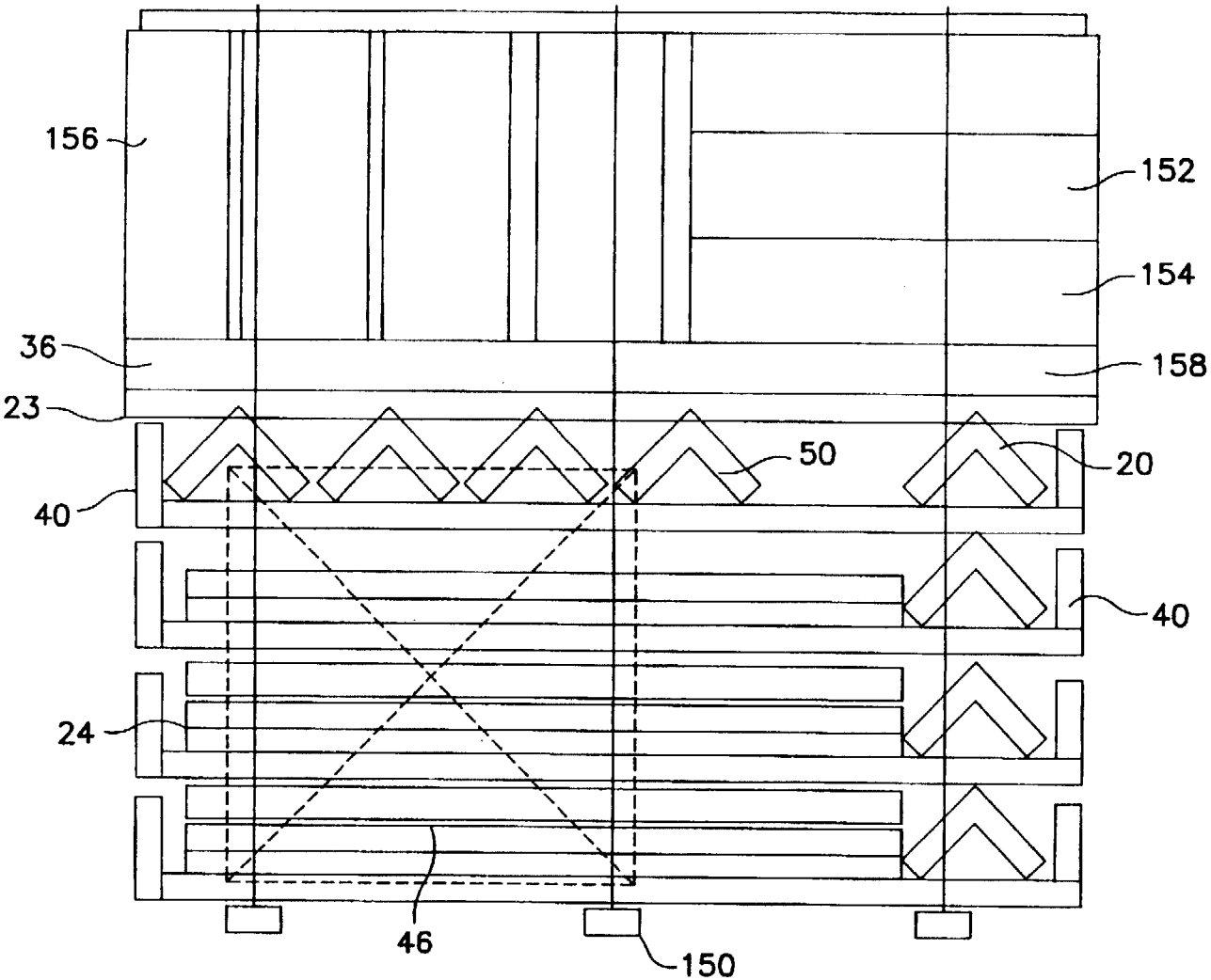
FIG. 15 is a side view of a typical shipping pallet showing a complete set of materials and other building elements ready to be shipped to a building site and assembled into the single story building structure shown in FIG. 1.
Figure 16A:
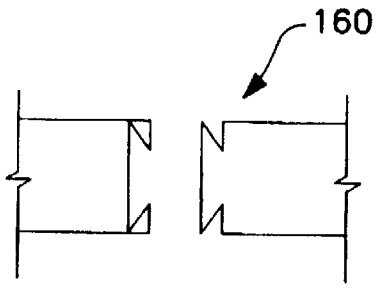
FIGS. 16A–16F are partial prospective views of typical friction lock means for joining panels and other building elements.
Figure 16B:
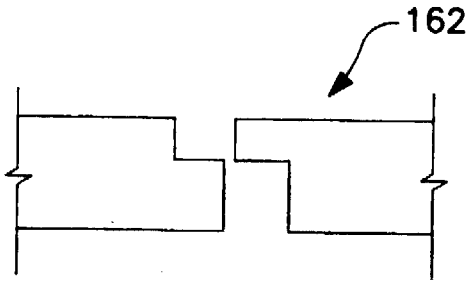
Figure 16C:
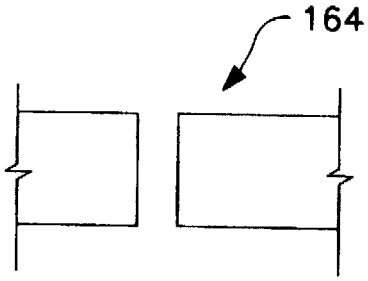
Figure 16D:
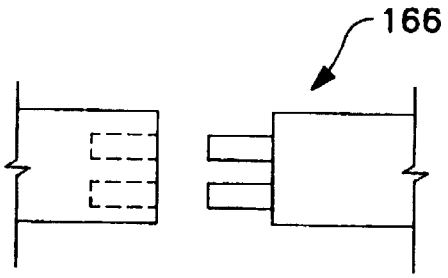
Figure 16E:
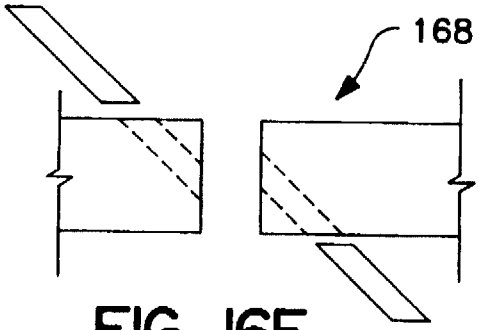
Figure 16F:
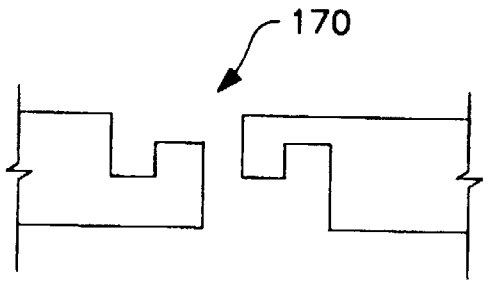

FIG. 15 shows pallet 150 with all of the building elements and other materials used in the assembly of the one single story building shown in FIG. 1. Specifically, the elements and other materials consist of four corner panels 20, 16 wall panels 24, four wall panels 22, two T-panels 26, one interior wall panel 28, one interior corner panel 29, four roof panels 40, four roof panels 42, one roof cap 46, four roof ridges 50, support beams 54, eight overhang roof panels 60, four windows 23 and their window surrounds, two doors 36 and their door jams, four downspouts 62, sink 152, range 154, toilet 156, shower 158, under the sink/range cabinets, electrical fixtures, plumbing items and miscellaneous items. The total weight of the wall and roof panels for a 400 square foot unit building is approximately 1300 pounds.

FIGS. 16A–16F respectively show lap joint or lab splice 160, dove tail joint 162, dowel joint 164, pin fitting joint 166, compression fitting joint 168, and tenon and mortise 170 as alternate means to the tongue and groove shown in FIGS. 8–12 for joining one panel to another.

Figure 17:
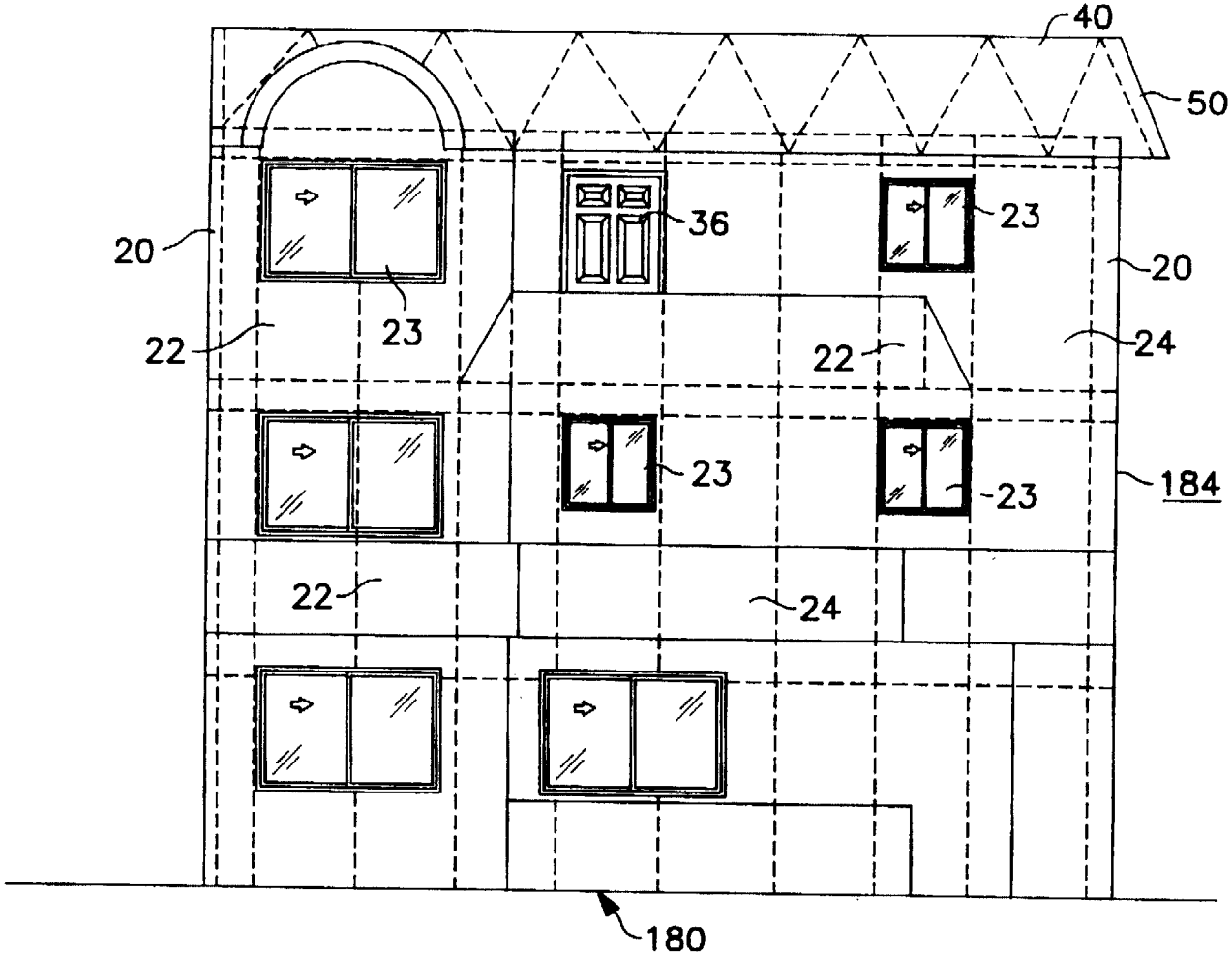
FIG. 17 is a front elevational view of another embodiment of the present invention, a lightweight, prefabricated three story residential or commercial building.
Figure 18:
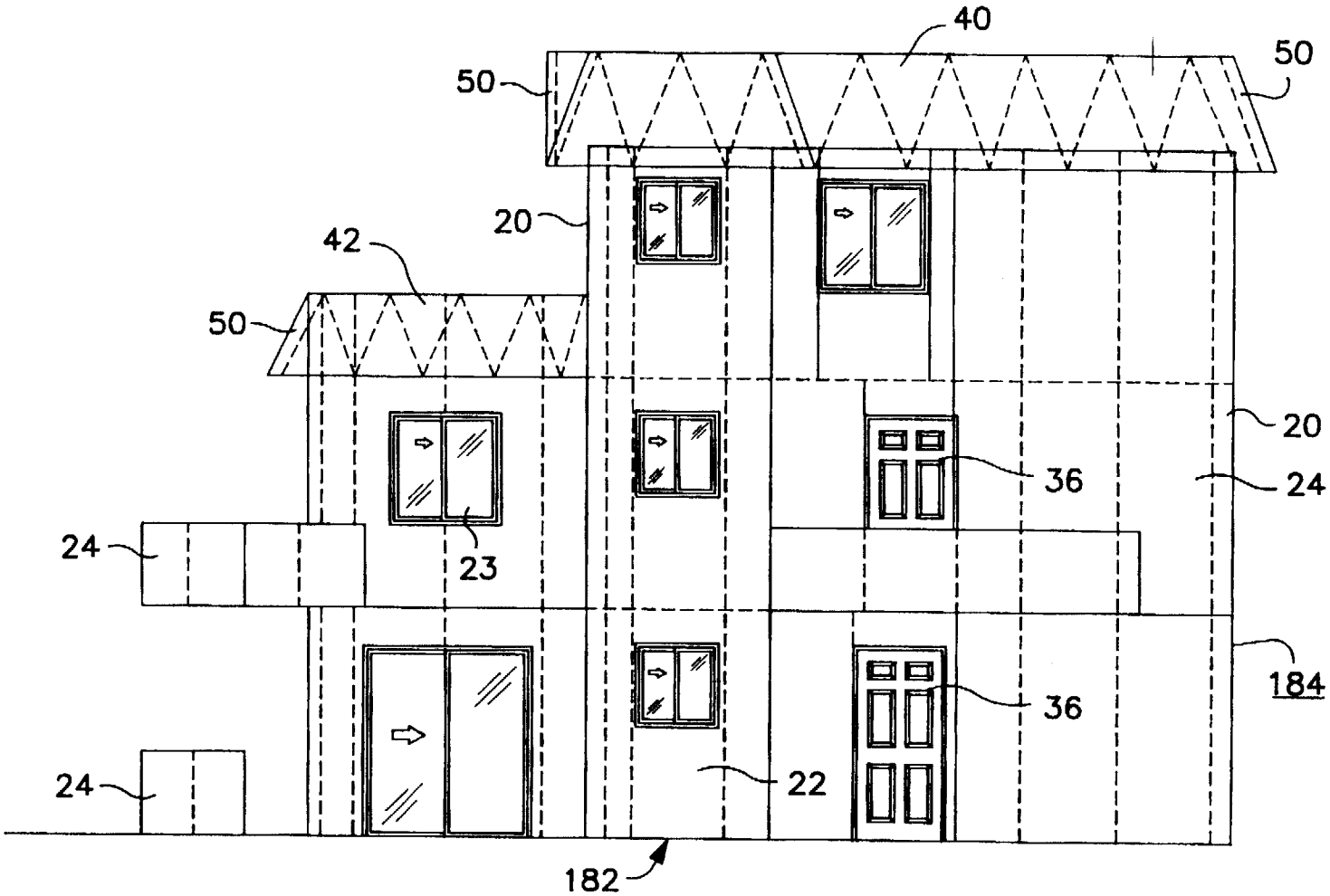
FIG. 18 is a rear elevational view of the building shown in FIG. 17.

FIGS. 17 and 18 show front 180 and rear 182 of multi-story residential or commercial building 184 of another embodiment of the present invention from the same corner panels 20, wall panels 22, wall panels 24, and T-panels 26 described above in connection with the single story embodiment of the present invention.

Figure 19:
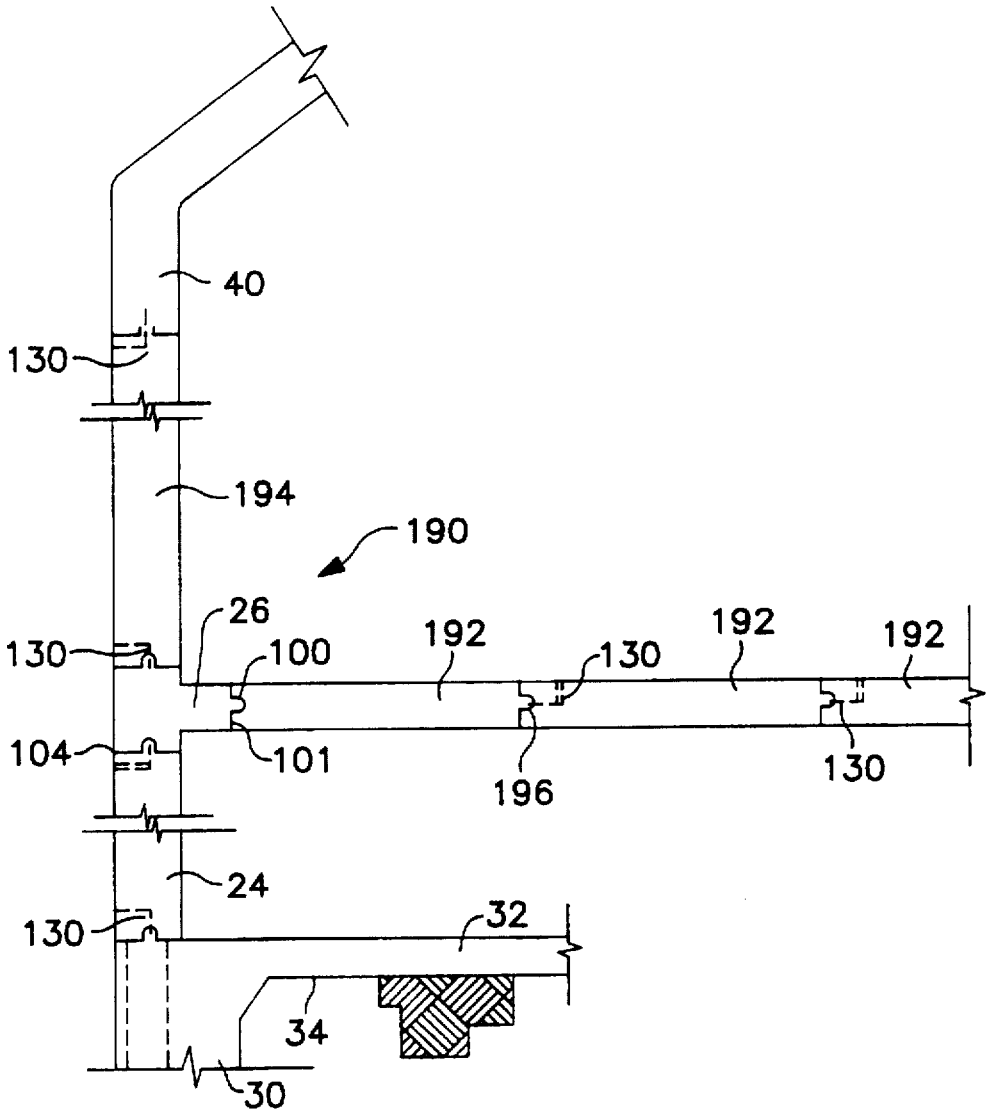
FIG. 19 is a partial prospective view of a floor separation member and floor panels used in the assembly of the multi-story building shown in FIGS. 17–18.

Referring now to FIG. 19, a portion of multi-story building 190 is shown in which floor panel 192 is locked by tongue and groove to T-panel 26 between upper wall panel 194 and lower wall panel 24. Specifically, tongue 100 along interior side edge 101 of T-panel 26 joins groove 196 along an edge of floor panel 192. T-panel 26 serves as a floor separation member for each of the subsequent floors of the structure. Upper wall panel 194 is positively attached to roof panel 40 by means of CAM-LOCK attachment means 130 and lower wall panel 24 is positively attached to foundation 34 by means of CAM-LOCK attachment means 130 in the same manner as described above. CAM-LOCK attachment means 130 are also used to provide additional support between upper wall 194 and T-panel 26, between lower wall panel 24 and T-panel 26, and between each of the floor panels 192.

The example below describes the chemistry of a specific type of PUR foam for use in the molding of the panels and other elements of the present invention. It is apparent to one skilled in the polyurethane foam art that practically an infinite variety of combinations of the following materials can be used to produce PUR foams having a wide variety of physical properties These materials include polyols, isocyanates, surfactants, catalysts, blowing agents, foam stabilizers, oxidants, and other additives which are commercially available. The commercial formulation set forth below is just one example of the type that has the minimum physical properties for the production of building elements of the present invention.

EXAMPLE 1

A PUR foam system comprising approximately 50 parts by weight of a diphenyl methylene diisocyante-containing mixture (Component A) and approximately 50 parts by weight of a polyol-containing mixture (Component B), an amine catalyst and a 1141 B blowing agent was used in a standard foaming procedure to produce test plaques measuring one foot long, one foot wide and three and a half inches thick. The PUR foam system used in the example is commercially available under the trademark PDL-1305 PUR by PDL Corporation. In this procedure, Component A and Component B together with the proprietary amine catalyst and the blowing agent that are included in the PUR foam system were simultaneously introduced into a containment vessel or mold having the internal measurements of the test plaque using a precision metering pump. Component A has a Brookfield LVF viscosity in the range of about 200–400 cps, a specific gravity (via ASTM D-1638) of about 1.17 and a density of about 9.8 pounds/gallon. Component B has a Brookfield LVF viscosity of approximately 700 cps, a specific gravity of about 1.24 and a density of about 10.3 pounds/gallon. The blowing agent was a hydrochlorofluorocarbon (HCFC).

Measurements were taken during the foaming procedure for the cream time, gel time, tack-free time, all at 77° F. and the free-rise density of the resultant core and the results are set forth in the table below:

| Property | Results, seconds |
|---|---|
| Cream Time | 30 |
| String Gel Time | 30–60 |
| Tack-Free Time | 50–90 |
| Free Rise Density (Core) | 2.2–2.7 |

The resulting two component system, self-skinning PUR foam had the following minimum properties:

| Property | Test Method | Results |
|---|---|---|
| Density | ASTM D-1622 | 3.2 |
| Closed Cells, % min. | ASTM D-2856 | 92% |
| Flammability | ASTM D-2883 | Pass |
| Compressive Strength, psi | ASTM D-1621 (Procedure "A") | 54 |
| Compressive Modulus, psi | ASTM D-1621 | 1500 |
| Shear Strength, psi | ASTM D-273 | 50 |
| Tensile Strength, psi | ASTM D-1623 | 60 |
| Tensile Modulus, psi | ASTM D-1623 | 100 |
| Water Absorption, vol. % (24 hrs. immersion lbs./sq. ft. surface area) | ASTM D-2842 | .01 |
| Thermal Conductivity, BTU/hr./ft.$^2$/°F./in. | ASTM C-177 | 0.12 |
| Resistance to Simulated Service Conditions | | |
| % vol. change | ASTM D-2126 | 1% |

It will be apparent to one skilled in the chemistries of polyurethane foam that the vapor pressure of the specific blowing gas used in the PUR foam system and the surface tension of the foam cells at the surface of the mold combined with the particular surfactant of the formulation will dictate the rate of cellular breakdown. This rate of cellular breakdown versus the temperature of the mold dictates the rate at which the gaseous content is released or "blows-off" from the foam during gel time. The rate of gas blows-off causes the foam to become elastomeric at the surface or the skin of the foam panel by forming a much higher density on the skin of the molded part versus the core density. Such variations in the PUR foam formulation produce a variety of self-skinning parts. This skin with additives can provide for the protection of ultraviolet light of varying intensities. Resistance against vandalism, impact and shock resistance of varying characteristics. In addition, the interior walls of the mold can be varied to provide a full range of wall textures for aesthetic purposes and cosmetic appeal. Finally, the wall thickness, skin thickness, and density of the formulation can be varied to provide various structural and performance characteristics for the particular environmental conditions at the building site. Preferably at least one male fastener is molded within each of the wall panels during the molding operation.

Without departing from the spirit and scope of this invention, one of ordinary skill in the art can make many other changes and modifications to the chemical formulation of the panels and other building elements and to their geometric shape and their assembly into a variety of different building structures of the present invention to adapt them to specific usages and conditions. As such, these changes and modifications are properly, equitably, and intended to be, within the full range of equivalents of the following claims.

What is claimed is:

1. A lightweight, prefabricated building structure comprising the following elements:

a plurality of wall panels having upper and lower sections and having positive attachment means for attaching each of said wall panels to a foundation, and friction lock means for joining said wall panels; said positive attachment means comprising a plurality of com-lock fasteners, each of said com-lock fasteners having a female insert about every six to eighteen inches of the periphery of and fixedly attached to said foundation, at least one male insert molded within said lower section of each of said plurality of wall panels for locking with said female insert, said male insert comprising a moveable hook to be in registry with a corresponding one of said female inserts, whereby when each of said movable hooks is driven into said corresponding one of said female inserts, the positive attachment means provides sufficient strength for the resulting building structure to withstand severe winds; and a plurality of roof panels joinable to said upper sections of said wall panels by friction lock means.

2. The structure of claim 1 wherein said wall panels and roof panels comprise rigid polyurethane foam.

3. The structure of claim 1 wherein said attachment means also comprises an adhesive.

4. The structure of claim 2 wherein said moveable hook consists essentially of a metal, engineering plastic and injection molded nylon.

5. The structure of claim 1 wherein said friction lock means comprises lap joints, lap splices, dove tail joints, dowel joints, pin fitting joints, compression fitting joints, tenon and mortise, and tongue and groove.

6. The structure of claim 1 wherein additional elements comprise a plurality of corner panels having friction lock means for joining said corner panels to said wall panel.

7. The structure of claim 6 wherein said wall panels and said corner panels are joined to each other by tongue and groove friction lock means comprising a tongue along one side edge and a groove along the other side edge of said panels, said wall panels and corner panels are joined to roof panels and said roof panels are joined to each other by said tongue and groove friction lock means.

8. The structure of claim 1 wherein each of a plurality of overhang roof panels is joinable to each of said roof panels.

9. The structure of claim 8 wherein each of said overhang roof panels has a grooved channel to serve as a gutter.

10. The structure of claim 9 wherein at least one downspout is connected to one grooved channel.

11. The structure of claim 6 wherein each of said wall panels and corner panels has an interior wall and an exterior wall.

12. The structure of claim 11 wherein additional elements comprise a plurality of interior wall panels and a plurality of combination interior-exterior wall panels and wherein an interior side edge of each combination interior-exterior wall panel is joinable to one side edge of said interior wall panels by friction lock means and each exterior side edge is joinable between a side edge of each of said wall panels adjacent to said combination interior-exterior wall panel by friction lock means.

13. The structure of claim 12 wherein said additional elements also comprise at least one wall panel to accommodate a window.

14. The structure of claim 13 wherein said additional elements also comprise at least one door mounted between two wall panels.

15. The structure of claim 14 wherein said plurality of elements form a single story residential building.

16. The structure of claim 15 wherein each of the plurality of elements have dimensions of length, width and thickness which are compatible for shipment via a single shipping pallet.

17. The structure of claim 11 wherein said plurality of elements form a multi-story residential building.

18. The structure of claim 6 wherein an additional element comprises at least one door panel mounted between two wall panels.

19. The structure of claim 18 wherein said plurality of elements form a single story commercial building.

20. The structure of claim 18 wherein said plurality of elements form a multi-story commercial building.

21. A lightweight, prefabricated building structure comprising the following elements consisting of rigid polyurethane foam:

a plurality of wall panels, each of said wall panels having a length in the range of about one to 50 feet, a width in the range from about six inches to about 20 feet, a thickness in the range from about one to about six inches, a top edge, a bottom edge having positive attachment means for attaching said wall panel to a foundation, a first side edge having a tongue extending along substantially the entire length of said panel and a second side edge having a groove extending along substantially the entire length of said panel for receiving a tongue of a first side edge of one of said wall panels to another of said wall panels and for joining said wall panels one to another, said positive attachment means comprising a plurality of com-lock fasteners, each of said com-lock fasteners having a female insert about every six to eighteen inches of the periphery of and fixedly attached to said foundation, at least one male insert molded within said lower section of each of said plurality of wall panels for locking with said female insert, said male insert comprising a movable hook to be in a registry with a corresponding one of said female inserts, whereby when each of said movable hooks is driven into said corresponding one of said female inserts, the positive attachment means provides sufficient strength for the resulting building structure to withstand severe winds;

at least four corner panels each having a top edge, a bottom edge having said attachment means, a first corner side having a tongue extending along substantially the entire length of said panel for joining to a groove of said first side edge one of said wall panels and a second corner side having a groove extending along substantially the entire length of said panel for receiving a tongue of a first side edge of another of said wall panels and for joining to said wall panels; and a plurality of roof panels joinable by tongue and groove and those roof panels adjacent to said wall panels and said corner panels joinable to the respective top edge of said wall panel and said corner by tongue and groove.

22. The structure of claim 21 wherein an adhesive is applied between said foundation and the bottom edge of said wall panels.

23. The structure of claim 21 wherein said moveable hook consists essentially of a metal, engineering plastic and injection molded nylon.

24. The structure of claim 21 wherein each of a plurality of overhang roof panels is joinable to each of said roof panels.

25. The structure of claim 24 wherein each of said overhang roof panels has a grooved channel to serve as a gutter.

26. The structure of claim 25 wherein at least one downspout is connected to one grooved channel.

27. The structure of claim 21 wherein each of said wall panels and corner panels has an interior wall and an exterior wall.

28. The structure of claim 27 wherein additional elements comprise a plurality of interior wall panels and a plurality of combination interior-exterior wall panels and wherein an interior side edge of each combination interior-exterior wall panel is joinable to one side edge of said interior wall panels by tongue and groove and each exterior side edge is joinable between a side edge of each of said wall panels adjacent to said combination interior-exterior wall panel by tongue and groove.

29. The structure of claim 28 wherein said additional elements also comprise at least one wall panel to accommodate a window.

30. The structure of claim 29 wherein said additional elements also comprises at least one door panel mounted between two wall panels.

31. The structure of claim 30 wherein said plurality of elements form a residential building having at least one story.

32. The structure of claim 31 wherein said plurality of elements form a single story residential building.

33. The structure of claim 32 wherein each of the plurality of elements are compatible for shipment via a single shipping pallet.

34. The structure of claim 33 wherein an additional element comprises at least one door panel mounted between two wall panels.

35. The structure of claim 34 wherein said plurality of elements form a commercial building having at least one story.

36. The structure of claim 35 wherein said plurality of elements form a multi-story commercial building.

37. A panel for assembly of lightweight building structures comprising an interior wall, an exterior wall, a first side edge, a second side edge, a top edge and a bottom edge, said interior wall being separated from said exterior wall by a thickness of at least one inch, said first side edge having a groove along substantially the entire length of said first side edge and having a depth of slightly greater than the thickness of said panel and a tongue along substantially the entire length of said second side edge for mating with said groove, said top edge joinable to a roof by tongue and groove, and positive attachment means for attaching to a foundation within said bottom edge, said positive attachment means comprising a plurality of com-lock fasteners, each of said com-lock fasteners having a female insert about every six to eighteen inches of the periphery of and fixedly attached to said foundation, at least one male insert within said lower section of each of said plurality of wall panels for locking with said female insert, said male insert comprising a moveable rod to be in registry with a corresponding one of said female inserts, whereby when each of said movable hook is driven into said corresponding one of said female inserts, the positive attachment means provides sufficient strength for the resulting building structure to withstand severe winds.

38. The panel of claim 37 wherein said panel comprises rigid polyurethane foam.

39. The panel of claim 38 wherein said moveable hook consists essentially of a metal, engineering plastic and injection molded nylon.

40. The panel of claim 37 wherein said top edge is joinable to a roof panel by tongue and groove.

41. The panel of claim 37 wherein said top edge is joinable to a floor panel by tongue and groove.

* * * * *

UNITED STATES PATENT AND TRADEMARK OFFICE

CERTIFICATE OF CORRECTION

PATENT NO. : 5,758,461
DATED : June 2, 1998
INVENTOR(S) : Frank J. McManus

It is certified that error appears in the above-identified patent and that said Letters Patent is hereby corrected as shown below:

Column 9, line 18, delete "1%" and insert therefor --<1%--.

Column 9, line 62, delete "com-lock" and insert therefor --CAM-LOCK--.

Column 9, line 63, delete "com-lock" and insert therefor --CAM-LOCK--.

Column 11, line 19, delete "com-lock" and insert therefor --CAM-LOCK--.

Column 11, line 20, delete "com-lock" and insert therefor --CAM-LOCK--.

Column 12, line 42, delete "com-lock" and insert therefor --CAM-LOCK--.

Column 12, line 43, delete "com-lock" and insert therefor --CAM-LOCK--.

Signed and Sealed this

Thirteenth Day of July, 1999

*Attest:*

Q. TODD DICKINSON

*Attesting Officer*

*Acting Commissioner of Patents and Trademarks*